US006039596A

United States Patent [19]

Whiteman, Jr. et al.

[11] Patent Number: 6,039,596

[45] Date of Patent: Mar. 21, 2000

[54] GASKETS FOR POWER CABLE TAP CONNECTOR

[75] Inventors: Robert Neil Whiteman, Jr., Middletown; Earl William McCleerey, Mechanicsburg; Jeffrey Byron McClinton, Harrisburg, all of Pa.

[73] Assignee: The Whitaker Corporation, Wilmington, Del.

[21] Appl. No.: 09/170,348

[22] Filed: Oct. 13, 1998

Related U.S. Application Data

[60] Provisional application No. 60/064,998, Nov. 10, 1997.

[51] Int. Cl.[7] ..... H01R 4/20

[52] U.S. Cl. ..... 439/404; 439/587

[58] Field of Search ..... 439/589, 413, 439/274, 587, 409, 410, 411, 412, 417, 419, 404, 271

[56] References Cited

U.S. PATENT DOCUMENTS

| | | | |
|---|---|---|---|
| 2,627,537 | 2/1953 | Weisberg | 173/361 |
| 3,879,575 | 4/1975 | Dobbin et al. | 174/92 |
| 4,575,169 | 3/1986 | Duplatre et al. | 339/44 |
| 4,637,674 | 1/1987 | Kobler | 339/94 |
| 4,743,080 | 5/1988 | Siraty | 439/492 |
| 4,935,582 | 6/1990 | Calligaris | 174/92 |
| 4,963,700 | 10/1990 | Olsen et al. | 174/138 F |
| 5,139,440 | 8/1992 | Volk et al. | 439/413 |
| 5,192,832 | 3/1993 | Rudy, Jr. et al. | 174/52.1 |
| 5,302,144 | 4/1994 | Francois et al. | 439/781 |
| 5,323,454 | 6/1994 | Shay et al. | 379/327 |
| 5,397,859 | 3/1995 | Robertson et al. | 174/92 |
| 5,453,022 | 9/1995 | Staiger | 439/404 |
| 5,704,801 | 1/1998 | Walker et al. | 439/417 |
| 5,893,774 | 4/1999 | Lin | 439/419 |

OTHER PUBLICATIONS

*AMP Catalog 82065*, "AMP Mini–Drop Wire Splice," (May 1993); 2 pages; AMP Incorporated, Harrisburg, PA.

*AMP Catalog 65689*, "AMP Mini–Drop Wire Splice," (Sep. 1996); p. 96; AMP Incorporated, Harrisburg.

U.S. Ser. No. 09/056,083, filed Apr. 7, 1998 (Abstract and drawings only).

*Primary Examiner*—Neil Abrams
*Assistant Examiner*—Brian S. Webb

[57] ABSTRACT

Connector (10) for termination to a multiconductor cable (12) remote from an end thereof and including a housing (20) and a cover (22) securable to each other around the cable, defining a channel (32) therethrough. Housing (20) contains a plurality of contacts (60) with first contact sections (66) in slots (62) that open onto the assembly face adjacent the cable jacket to penetrate the cable insulation and establish electrical connections with the cable's conductors (16). A pair of gaskets (100,102) are mounted to the housing and cover (20,22) and seated within grooves (104, 106) thereof, with cable-engaging portions (132) extending outwardly of the grooves to be engaged by and compressed by the cable (12) during application of the connector to the cable, being compressed into the grooves (104,106), surrounding and sealing the sites where the contacts will penetrate the cable insulation during termination.

13 Claims, 5 Drawing Sheets

GASKETS FOR POWER CABLE TAP CONNECTOR

This application claims the benefit of U.S. Provisional application(s) No(s). 60/064,998, filed Nov. 10, 1997.

FIELD OF THE INVENTION

This relates to the field of electrical connectors and more particularly to connectors for establishing a tap connection to multiconductor cable.

BACKGROUND OF THE INVENTION

For establishing taps to cables such as heavily jacketed cables having a plurality of conductors for transmission of electrical power, especially direct current power, or transmission of both power and signals, one type of connector is easily appliable to the cable with only standard tools, at a point of the cable remote from an end thereof. The connector includes a pair of insulative members movable together about a cable length and that are secured together with the cable nested in position. For each conductor of the cable, at least one contact is contained in a first insulative member or housing and includes a slotted conductor-engaging section aligned with the conductor. An actuator of the connector is moved such as by a tool, to move the contact toward the cable such that the conductor-engaging section penetrates the cable jacket until the conductor therewithin is fully received into the slot, with slot edges compressing against the conductor establishing an electrical connection therewith. The connector defines a mating face for establishing electrical connections with another electrical article such as a tap cable.

It is desired to provide gaskets for use in the housing that together will seal around the electrical connections with the conductors of the cable.

It is also desired to provide gaskets that will seal directly to the cable insulation.

SUMMARY OF THE INVENTION

In the present invention, a pair of gaskets are secured to the upper and lower insulative housing members of the connector along the cable-receiving channel therebetween. The gaskets will seal directly against the cable insulation upon mounting the connector to the cable to surround the sites at which contacts of the connector will penetrate the cable insulation and establish electrical connections with the respective cable conductors. Outer faces of the gaskets will seat within grooves of the insulative housings, while inner faces extend into the cable groove to be abutted by the cable during application of the connector thereto, and compressed thereby while also causing compression of the gasket portions within the grooves.

An embodiment of the present invention will now be described by way of example with reference to the drawings.

DETAILED DESCRIPTION OF THE EMBODIMENTS

Figure 1:
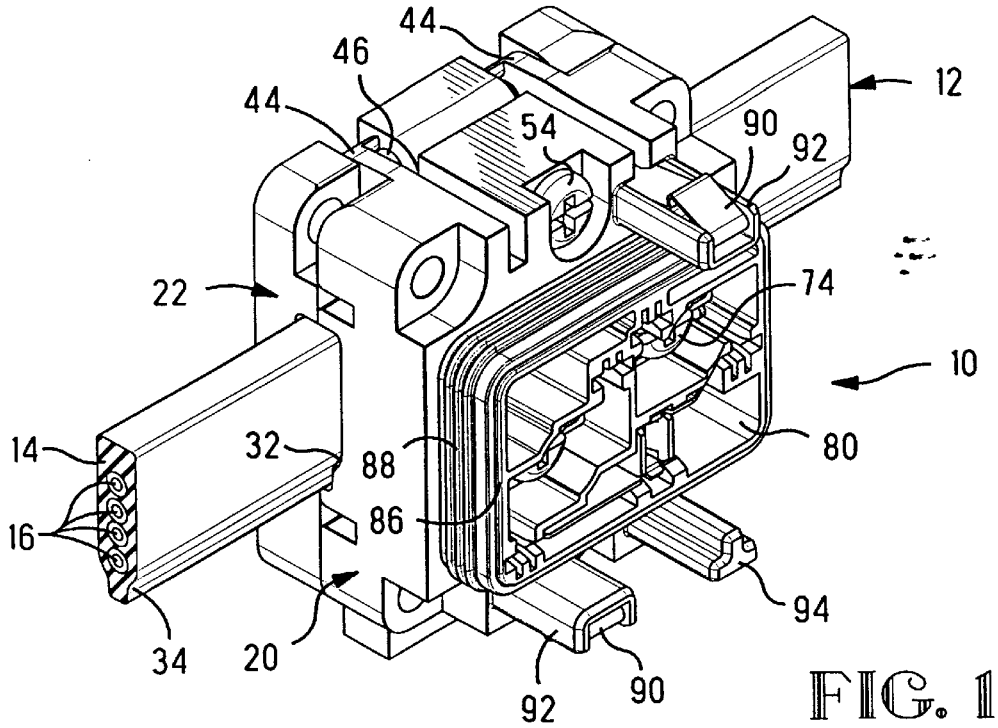
FIG. 1 is an isometric view of a first embodiment of the connector terminated to a cable.

Cable tap connector 10 is shown terminated to a cable 12 having an outer jacket 14 and, for example, four conductors 16. Connector 10 includes an insulative housing 20 and a second insulative member, cover 22 to which it is securable to surround cable 12 at a location remote from an end of the cable, as well as at a cable end. Housing 20 and cover 22 include shallow wide grooves 24,26 along assembly faces 28,30 thereof together defining cable-receiving channel or nest 32 that will clamp about the cable. The cable cross-section is shown to include a reduced thickness flange along one side, serving to polarize the orientation of the cable tap connector with respect to the cable, its cable-receiving channel being complementarily shaped, thus assuring that the power conductors and signal conductors are positioned appropriately for termination to the appropriate contact members of the connector. Cable tap connector 10 is disclosed in greater detail in U.S. patent application Ser. No. 09/056,083 filed Apr. 7, 1998 and assigned to the assignee hereof.

Also shown are gaskets 100,102 of the present invention and being for example of elastomeric material, that may be affixed to assembly faces 28,30 within respective gasket-receiving grooves 104,106 surrounding the termination sites within channel 32, being compressed directly against the upper and lower surfaces of cable 12 when the connector is fully mounted to the cable, to seal the termination region after termination from moisture, dust and gasses of the outside environment.

As seen in FIGS. 2 to 6, teeth 38 extend into cable-receiving grooves 24,26 to bite into cable 12 to assist in securing the cable in position against lateral movement. Antishear embossments 40 project from assembly face 30 of cover 22 to enter clearances 42 in assembly face 28 of housing 20 upon securing the connector to the cable, that enhance resistance to shearing should forces be applied to either the housing or the cover in a lateral direction.

Figure 3:
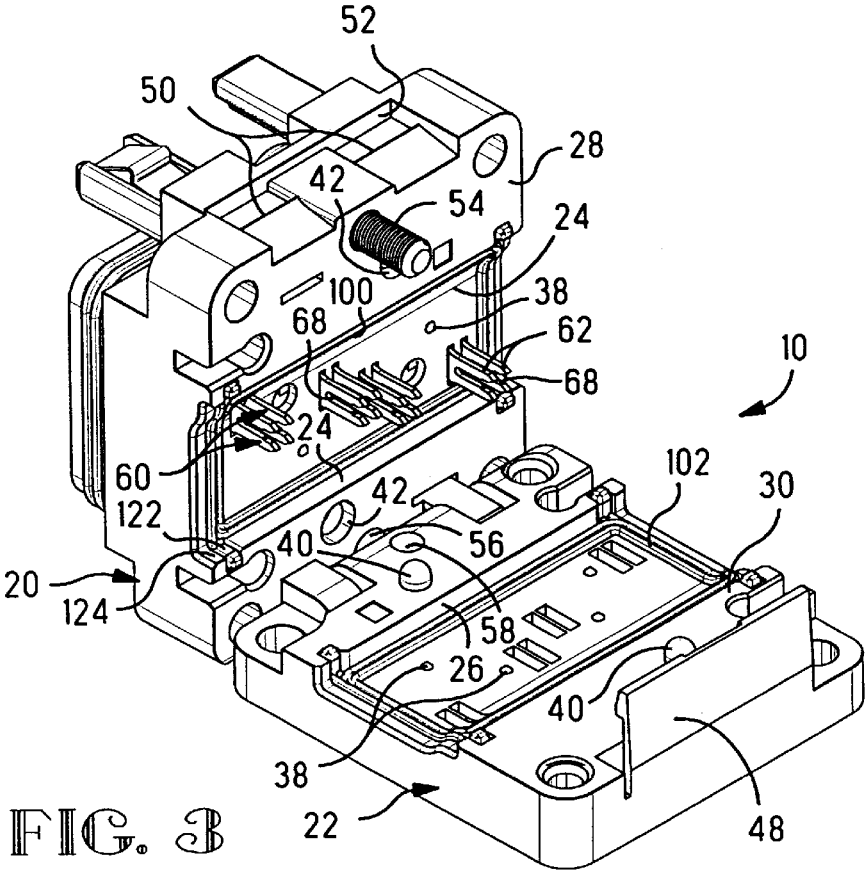
FIG. 3 is an isometric view of the housing and the cooperating member of the connector of FIGS. 1 and 2 hingedly joined in an open condition, but with the contacts shown in the actuated position for illustrative purposes.
Figure 2:
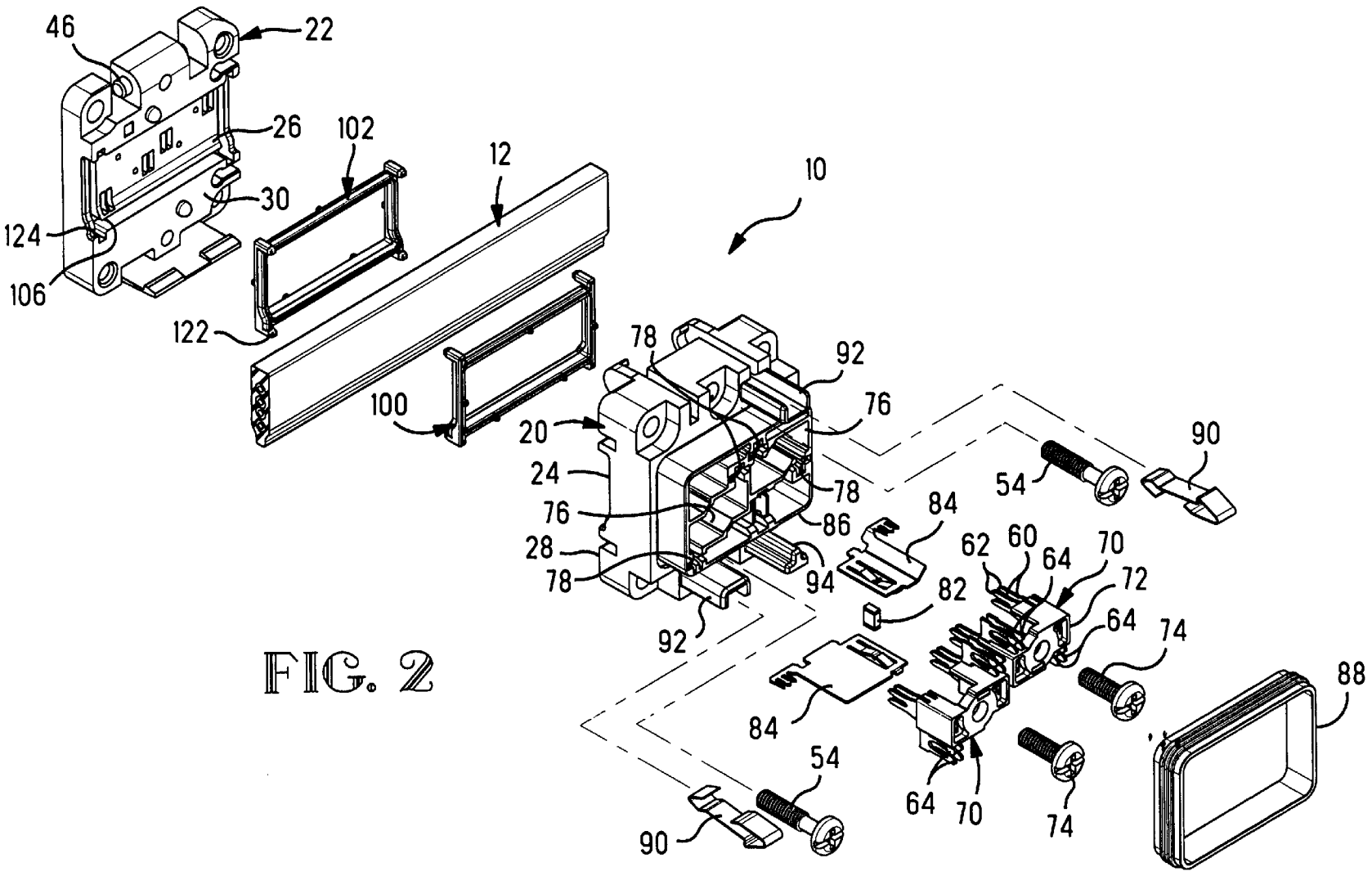
FIG. 2 is an exploded isometric view of the connector of FIG. 1.

Referring to FIGS. 1 to 3, housing 20 and cover 22 are securable to each other about cable 12; preferably, housing 20 and cover 22 are hingedly joined to each other, to be rotated together for assembly faces 28,30 to meet about the cable for grooves 24,26 to form cable-receiving channel 32. Housing 20 includes along a first side, a pair of pivot sections 44 cooperable with pivot pins 46 of cover 22 to pivot housing 20 toward cover 22. Latch arm 48 extends upwardly from assembly face 30 of cover 22 on an opposed second side from pivot pins 44, to latch with projections 50 of housing 20 along the opposed second side, with the latch-receiving recess 52 being a tamper-resistance feature to inhibit delatching of latch arm 48. Fasteners 54 are insertable through holes 56 of housing 20 to thread into apertures 58 of cover 22 to complete securing the housing to the cover prior to cable termination.

Now referring to FIGS. 2 to 5, connector 10 includes a plurality of contacts 60, associated in pairs with respective conductors 16 of cable 12 and having insulation displacement (IDC) or first contact sections 62 that will compressively engage conductors 16 upon termination, after connector 10 is assembled around the cable. The provision of a pair of contacts engaging each conductor increases the current-carrying capacity of the connector, with attendant advantages of substantially reduced heat generation and related temperature rise and substantially reduced losses, as well as redundancy. Contacts 60 also have second contact sections 64 exposed along mating face 80 of housing 20 after assembly and termination, for electrical connection with complementary contacts of an interface connector module (not shown).

Figure 4:
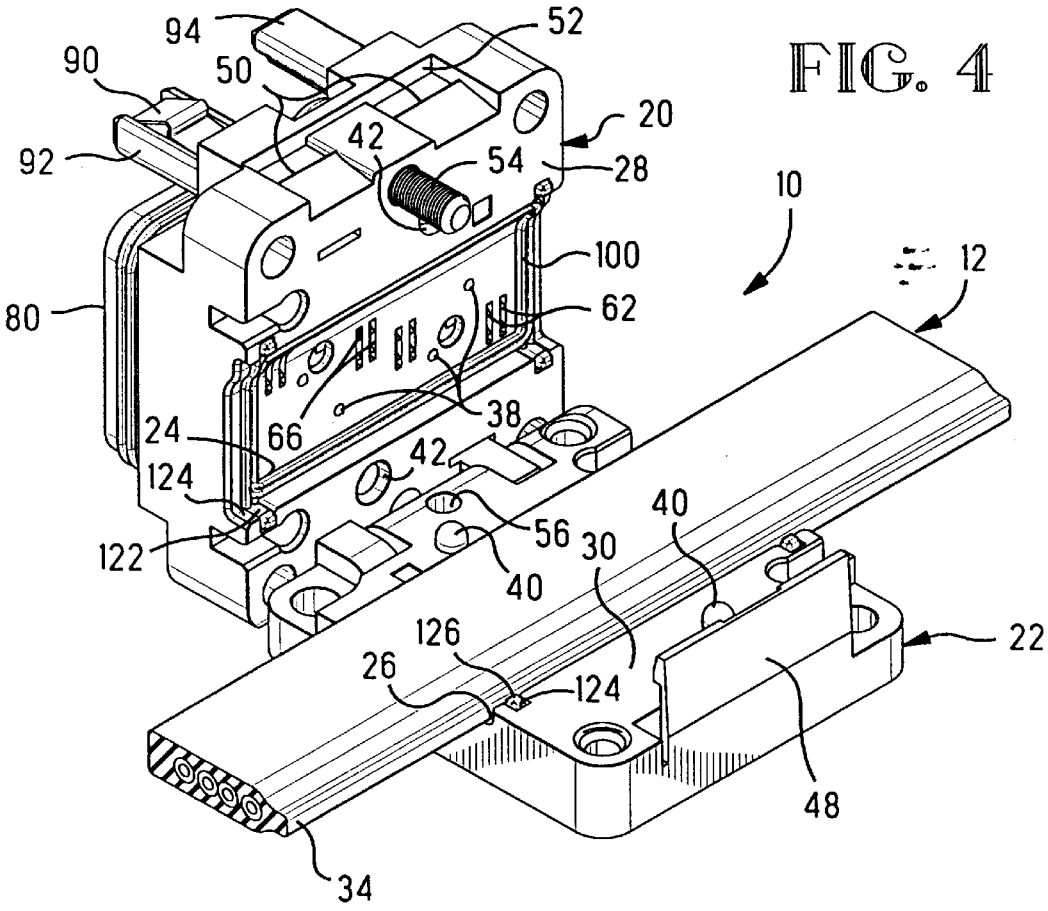
FIG. 4 is an isometric view of the connector of FIGS. 1 to 3 with a cable nested therein, with the contacts recessed prior to termination.
Figure 5:
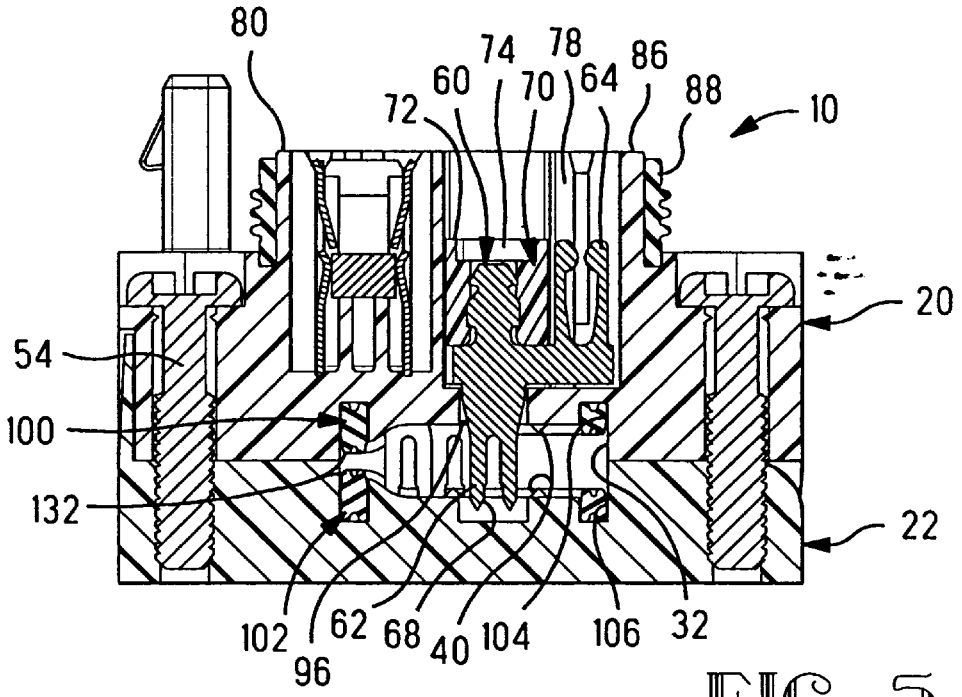
FIGS. 5 and 6 are cross-sectional views of the assembled connector of FIGS. 1 to 4 showing the terminal subassemblies after actuation but with no cable extending therethrough.

Contacts 60 are first secured within insulative carriers 72, seen best in FIGS. 2 and 5, to define terminal subassemblies 70 that also include actuators 74, and are secured therein by retention legs force fit into openings of insulative carriers 72. The subassemblies 70 are then secured in respective cavities 76 in mating face 80 of housing 20 such that IDC contact sections 62 are disposed within respective slots 66 of housing 20 that extend from mating face 80 to assembly face 28. IDC contact sections 62 are shown in FIG. 4 in their pretermination or recessed position within slots 66.

As seen best in FIG. 5, second contact sections 64 are shown to be of the tuning fork type adapted to receive blade-shaped contact sections in slots thereof between resilient beams, as is known. Preferably, second contact sections 64 are recessed within H-shaped blade-receiving slots 78 defined by insulative housing 20 along mating face 80, with the H-shaped blade-receiving slots assuring that the blade-shaped contact sections of the interface module are aligned properly to enter the slots 96 of the tuning fork contact sections.

Figure 6:
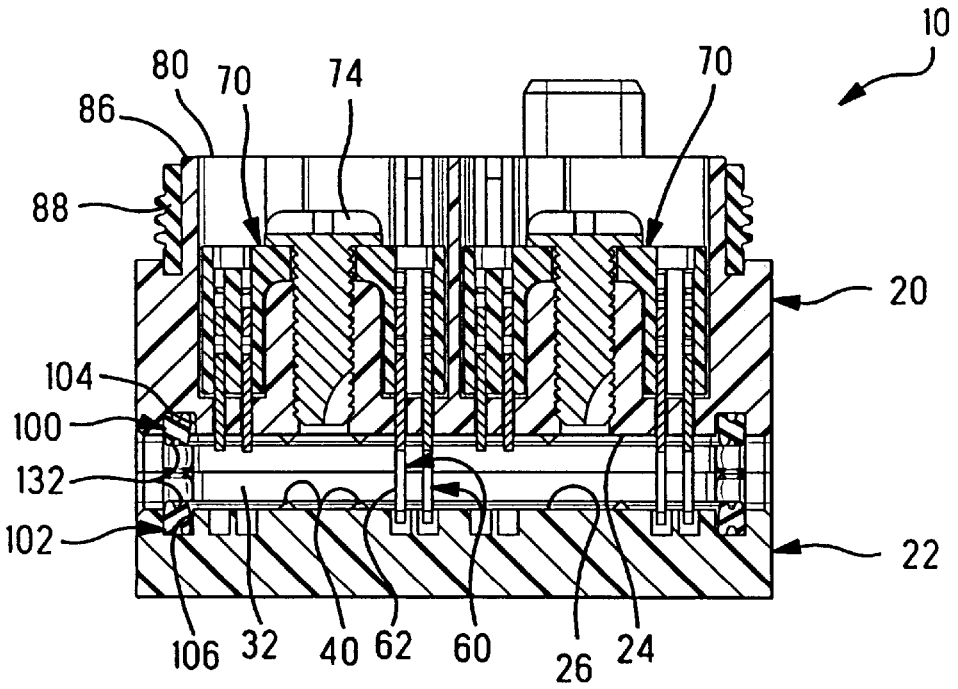

In FIGS. 3, 5 and 6, cable 12 has been omitted to reveal IDC contact sections 62 after actuation of actuators 74, in their terminated position extending beyond assembly face 28 of housing 20 into cable nest 32, for illustration purposes only, and are seen to include sharp points at ends of the beams of the contact sections to best penetrate the cable insulation upon actuation to terminate to conductors 16.

Preferably, two contact pairs are secured in each subassembly 70, associated respectively with power and signal conductors 16 of cable 12, and upon rotation of actuator 74 the contact carrier 72 moves the two pairs of contacts 60 in tandem or simultaneously toward cable 12. Initially, IDC contact sections 62 are recessed completely within slots 66 of housing 20 until after connector 10 is secured around cable 12, whereafter actuation of actuators 74 moves the contacts 60 toward the cable, when IDC contact sections 62 penetrate insulative jacket 14 of the cable and receive into their slots 68, the respective conductors 16 under assured compression to establish electrical connections therewith. Cable 12 has been omitted in FIGS. 5 and 6 to reveal the IDC contact sections after actuation of actuators 74.

Seen in FIG. 2 are a capacitor 82 and capacitor-engaging terminals 84 that electrically connect the capacitor in parallel between power circuits of the connector to minimize noise. Also seen in FIGS. 1 to 5 are a shroud 86 around mating interface 80, and an interface gasket 88 surrounds the shroud. Latches 90 are shown for latchingly securing a mating interface module, and silos 92 surrounding and protecting latches 90 and serving to align the interface module with connector 10 during mating. A key projection 94 serves to polarize the orientation of the module appropriately for mating.

Figure 9:
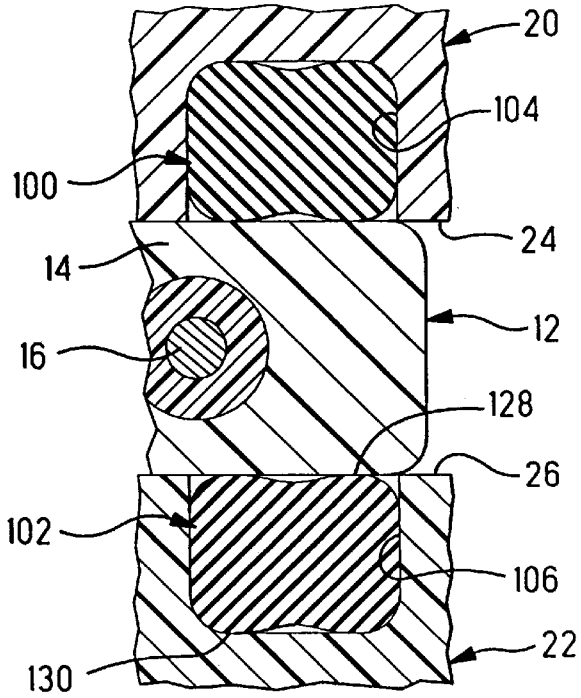
FIGS. 8 and 9 are simplified cross-section views of a gasket of FIG. 7 seated within a groove of the connector housing before and after sealing engagement with the cable.
Figure 7:
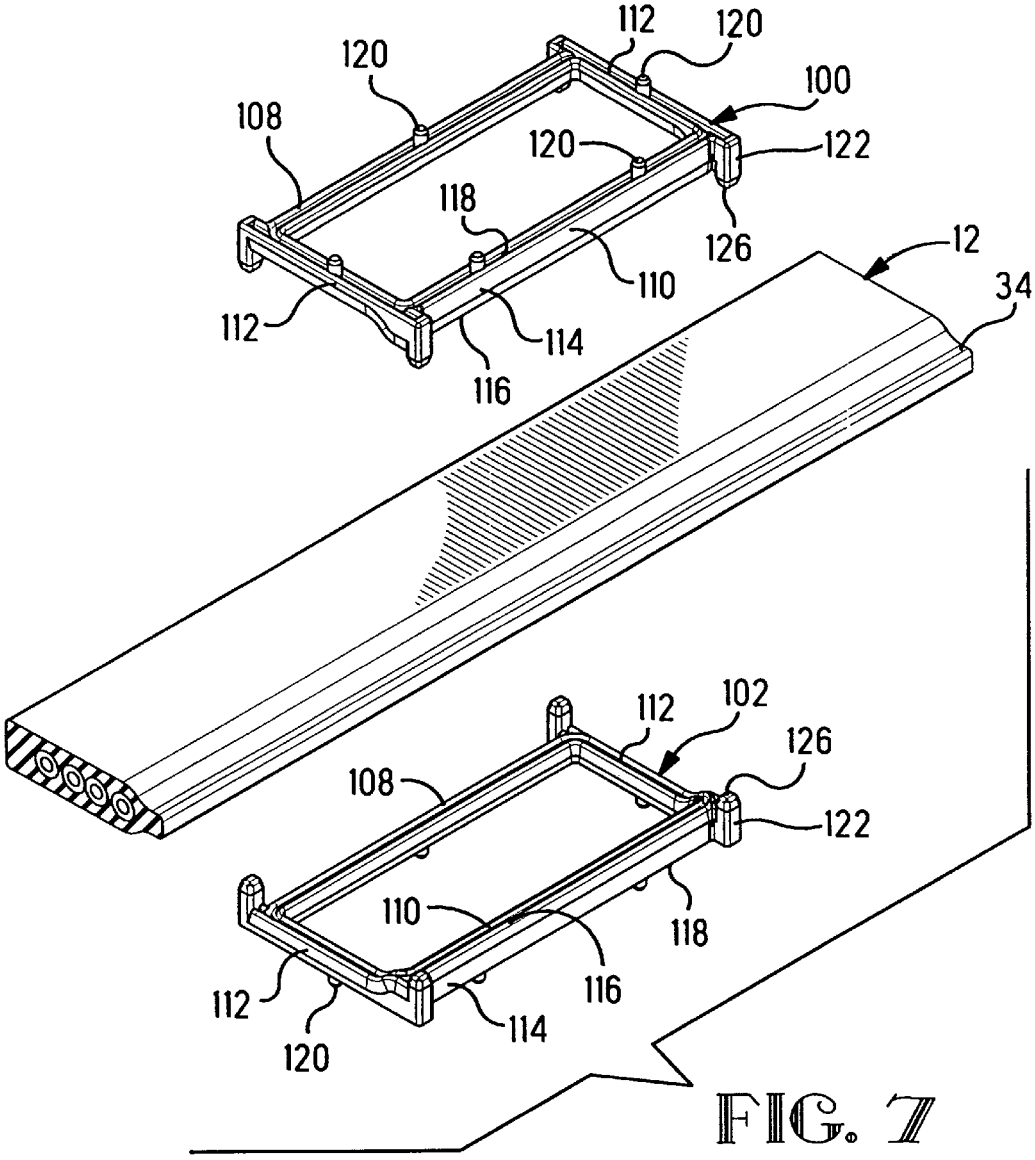
FIG. 7 is an isometric view of the gaskets of the present invention exploded from the cable of FIG. 1.
Figure 8:
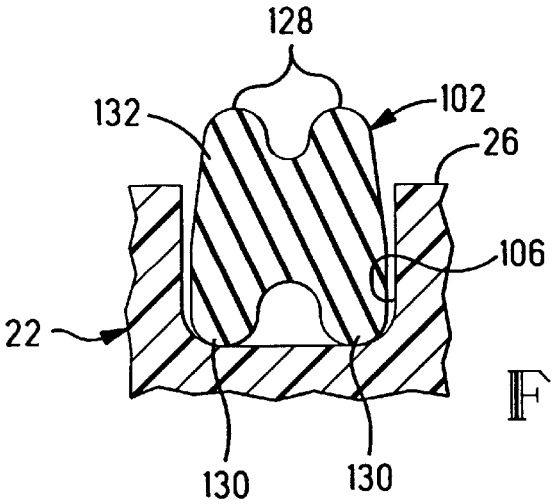

Referring again to FIGS. 5 and 6, and especially to FIGS. 7 to 9, gaskets 100,102 of the present invention are seen to include side sections 108,110 and end sections 112 joined in a continuous rectangular loop. Similarly, gasket-receiving grooves 104,106 of housing 20 and cover 22 form a continuous loop surrounding the termination region of the cable, defined in cable-receiving grooves 24,26 along assembly faces 28,30 of the connector. Gaskets 100,102 define side surfaces 114, a cable-facing surface 116 and a housing-facing surface 118. Side section 110 is shown to be taller than side section 108, extending from housing-facing surfaces 118 that are shown to be coplanar, and is associated with the flange 34 of cable 12 extending from one side of the cable; end sections 112 each are shaped to complement the contour of the cable along the major surfaces thereof particularly at flange 34.

The gaskets seal directly against the cable insulation upon mounting the connector to the cable. The outer faces of the gaskets seat within grooves of the insulative housings, while inner faces of the gaskets extend into the cable groove and are abutted by the cable during application of the connector to the cable. As can be seen in FIGS. 5 and 9, the side gasket sections 108, 110 extend along the top and bottom surfaces of the cable along the entire length of the cable that is in cable nest 32, as well as extend across the ends of the cable where it enters and exits cable nest 32. The end sections 112 of the gasket, therefore, have a length that is less than the width of the cable to assure that side sections 108, 110 lie along the side edges of the cable.

At corners of the gaskets are seen bosses 122 just outside of the loop that project beyond the cable-facing surface 116; and as seen in FIGS. 3 and 4, bosses 122 project beyond the assembly face of both housing 20 and cover 22. Bosses 122 of both housing 20 and cover 22 are seated within groove portions 124 and their ends 126 abut each other upon closure of the connector about the cable, thus compressing each other to fill the groove portions 124. It is seen that groove portions 124 are in communication with grooves 104,106 at ends thereof adjacent the cable exits, as an outer seal to prohibit leakage along the cable edge at the cable exits. Preferably, bosses 122 are slightly larger in dimension than the corresponding groove portions 124 and are force-fit thereinto, thereby serving to retain the gaskets in the respective cable-receiving grooves 104,106 prior to clamping of the connector about the cable. Optionally, small projections 120 extend from the housing-facing surface 118 of each of the gaskets to be received into complementary holes into the bottom of grooves 104,106 to facilitate gasket retention.

The cross-section of either gasket at any location along the loop is seen to have a cable-facing surface 116 having a pair of spaced lobes 128, and a housing-facing surface 118 having a pair of spaced lobes 130. Gasket-receiving grooves 104,106 are dimensioned just wider than the width of a gasket, and sufficiently deep to enable a cable-engaging portion 132 of the gasket cross-section to extend outwardly from a groove 104,106 when not under compression (FIG. 8), and to be fully received into the groove when fully compressed by the cable 12 as seen in FIG. 9. The gaskets may be made of, for example, nitrile rubber, ASTM Code NBR.

The gaskets are shown to be hermaphroditic, and the dimensions of the gaskets and complementary grooves, the lobed shape of the gaskets at both the cable-facing surface and housing-facing surface provide for compression that is sufficient to compensate for tolerances due to manufacturing processes, of the cable thickness, and the plastic housing and cover, and of the gaskets themselves, as well as to maintain pressure differential for leak-free submersion testing. The voids between the lobes allow minimum force for compression, facilitating closure of the housing and cover about the cable, and sufficient sealing occurs at either full or partial displacement of cable-engaging portions 132 into the grooves.

Modifications and variations may be made in the examples of gaskets and gasket-receiving grooves described herein, that are within the spirit of the invention and the scope of the claims.

What is claimed is:

1. An assembly for sealing around a termination site of an electrical cable within an electrical connector, comprising:

upper and lower housings having respective cable faces defining therebetween a cable-receiving channel through which extends the cable;

upper and lower gaskets each having side sections coextending along respective sides of said cable-receiving channel and each having end sections coextending between said side sections and traversing said cable-receiving channel proximate ends of said cable-receiving channel, said side and end sections defining a continuous loop around an enclosed region on respective upper and lower surfaces of said cable;

each of said upper and lower gaskets including cable-facing surfaces of said side and end sections protruding into said cable-receiving channel to be engaged and compressed by said cable upon said upper and lower housings being fastened about a length of said cable, sealing within said enclosed region an area along upper and lower surfaces of said cable for penetration of insulation of said cable by contacts of at least one of said upper and lower housings to electrically connect said contacts to conductors of said cable.

2. The assembly as set forth in claim 1 wherein said cable-facing surfaces of said upper and lower gaskets define in cross-section a pair of lobes extending in continuous loops around said enclosed region.

3. The assembly as set forth in claim 1 wherein said cable-facing surfaces of said end sections extend asymmetrically therealong to conform to a corresponding asymmetrical transverse surface of said cable.

4. The assembly as set forth in claim 1 wherein said upper and lower gaskets are hermaphroditic.

5. The assembly as set forth in claim 1 wherein said side sections and end sections of said upper and lower gaskets define a rectangle.

6. The assembly as set forth in claim 1 wherein said upper and lower gaskets are fabricated of elastomeric material.

7. The assembly as set forth in claim 1 wherein housing-facing surfaces of said upper and lower gaskets seat within corresponding gasket-receiving grooves in said cable faces of respective ones of said upper and lower housings that form a continuous loop around a termination region of the connector, in such a manner that said cable-facing surfaces are projected into said cable-receiving channel surrounding said termination region at least when said upper and lower gaskets are uncompressed prior to fastening said upper and lower housings about said cable.

8. The assembly as set forth in claim 7 wherein said housing-facing surfaces of at least said side sections include at least one projection extending into a corresponding hole into said bottom of said gasket-receiving groove for enhancing securing said upper and lower gaskets in said gasket-receiving grooves.

9. The assembly as set forth in claim 1 wherein said upper and lower gaskets include bosses projecting laterally outwardly therefrom adjacent cable exits of said cable-receiving channel and are received in corresponding recesses in said cable faces of said upper and lower housings, said bosses of each of said upper and lower gaskets projecting toward said bosses of the other thereof and protrude beyond respective said cable faces to abut together and be compressed to enhance sealing along sides of said cable adjacent said cable exits.

10. The assembly as set forth in claim 9 wherein said bosses are force-fit in said respective recesses.

11. A gasket for use in an electrical connector for sealing against a cable of selected width, comprising:

a member including opposed side sections and opposed end sections, said end sections having lengths less than said cable width, said side and end sections defining a continuous loop around an enclosed region, and having a cross-section extending continuously around said enclosed region that includes opposed faces orthogonal to said enclosed region each having a pair of spaced lobes that extend continuously around said enclosed region, to be compressed against said cable.

12. The gasket as set forth in claim 11 wherein said side sections and said end sections of said member define a rectangle.

13. The gasket as set forth in claim 11 wherein said member is fabricated of elastomeric material.

* * * * *